US009415991B2

(12) United States Patent
Green

(10) Patent No.: US 9,415,991 B2
(45) Date of Patent: Aug. 16, 2016

(54) BEVERAGE DISPENSER NOZZLE

(71) Applicant: The Coca-Cola Company, Atlanta, GA (US)

(72) Inventor: C. Brad Green, Dacula, GA (US)

(73) Assignee: THE COCA-COLA COMPANY, Atlanta, GA (US)

( * ) Notice: Subject to any disclaimer, the term of this patent is extended or adjusted under 35 U.S.C. 154(b) by 45 days.

(21) Appl. No.: 14/480,153

(22) Filed: Sep. 8, 2014

(65) Prior Publication Data

US 2015/0129614 A1 May 14, 2015

Related U.S. Application Data

(63) Continuation of application No. 14/211,106, filed on Mar. 14, 2014, now abandoned.

(60) Provisional application No. 61/793,229, filed on Mar. 15, 2013.

(51) Int. Cl.

| | |
|---|---|
| ***B67D 7/74*** | (2010.01) |
| ***B67D 1/00*** | (2006.01) |
| ***B67D 1/08*** | (2006.01) |
| ***B67D 1/12*** | (2006.01) |
| ***B67D 1/04*** | (2006.01) |

(52) U.S. Cl.

CPC ..... *B67D 1/0017* (2013.01); *B67D 1/006* (2013.01); *B67D 1/0021* (2013.01); *B67D 1/0051* (2013.01); *B67D 1/0058* (2013.01); *B67D 1/0081* (2013.01); *B67D 1/0406* (2013.01); *B67D 1/0884* (2013.01); *B67D 1/1204* (2013.01); *B67D 1/1279* (2013.01); *B67D 1/1286* (2013.01); *B67D 1/0888* (2013.01)

(58) Field of Classification Search

CPC .. B67D 1/0017; B67D 1/0021; B67D 1/0042; B67D 1/0044; B67D 1/0045; B67D 1/0048; B67D 1/0058; B67D 1/006; B67D 1/0051; B67D 1/0888; B67D 1/1204; B67D 1/1286; B67D 1/0081; B67D 1/0406; B67D 1/1279; B67D 1/0884

USPC ..... 222/129.1–129.4, 145.1, 145.5, 145.6, 222/566

See application file for complete search history.

(56) References Cited

U.S. PATENT DOCUMENTS

| | | | | |
|---|---|---|---|---|
| 2,910,247 | A * | 10/1959 | Allshouse | B67D 1/0051 137/170.5 |
| 4,520,950 | A | 6/1985 | Jeans | |
| 5,379,790 | A * | 1/1995 | Bruce | F16K 7/061 137/1 |
| 7,578,415 | B2 * | 8/2009 | Ziesel | B67D 1/0051 222/129.1 |
| 2010/0108787 | A1 * | 5/2010 | Walker | B05B 1/267 239/589 |

FOREIGN PATENT DOCUMENTS

| | | |
|---|---|---|
| GB | 1 401 185 | 7/1975 |

OTHER PUBLICATIONS

International Search Report dated Aug. 13, 2014 cited in Application No. PCT/US2014/026739, 13 pgs.

* cited by examiner

*Primary Examiner* — Lien Ngo

(57) ABSTRACT

An apparatus for controlling a fluid flow may include a flow channel, a housing, a flow restrictor, and a housing adjustment member. The flow channel defines a fluid pathway for the fluid flow. The fluid pathway includes an inlet and an exit. The housing surrounds the flow channel. The housing comprises an exterior surface defining a first threaded portion. The flow restrictor is located within the housing and proximate the exit. The housing adjustment member includes a second threaded portion in contact with the first threaded portion. Embodiments may include a method for controlling a fluid flow. The method comprises: causing the fluid flow to pass through a flow channel having an inlet and an exit; restricting, via a flow restrictor, the fluid flow, the flow restrictor located proximate the exit; and adjusting a position of the flow restrictor to further restrict or unrestrict the fluid flow.

14 Claims, 11 Drawing Sheets

BEVERAGE DISPENSER NOZZLE

CROSS-REFERENCE TO RELATED APPLICATIONS

This patent application claims priority to U.S. patent application Ser. No. 61/793,229, filed Mar. 15, 2013, entitled "Beverage Dispenser Nozzle," of which the disclosure is incorporated herein, in its entirety, by reference.

BACKGROUND

Beverage dispensers require ingredients to be added in order to form the beverage. Ingredients such as carbonated water can be delivered directly from a plumbing system. Ingredients that give a beverage its taste, color, etc., may be mixed via a nozzle to create a post-mix drink.

BRIEF DESCRIPTION OF THE DRAWINGS

The accompanying drawings, which are incorporated in and constitute a part of this disclosure, illustrate various embodiments of the present invention. In the drawings.

DESCRIPTION

Figure 1:
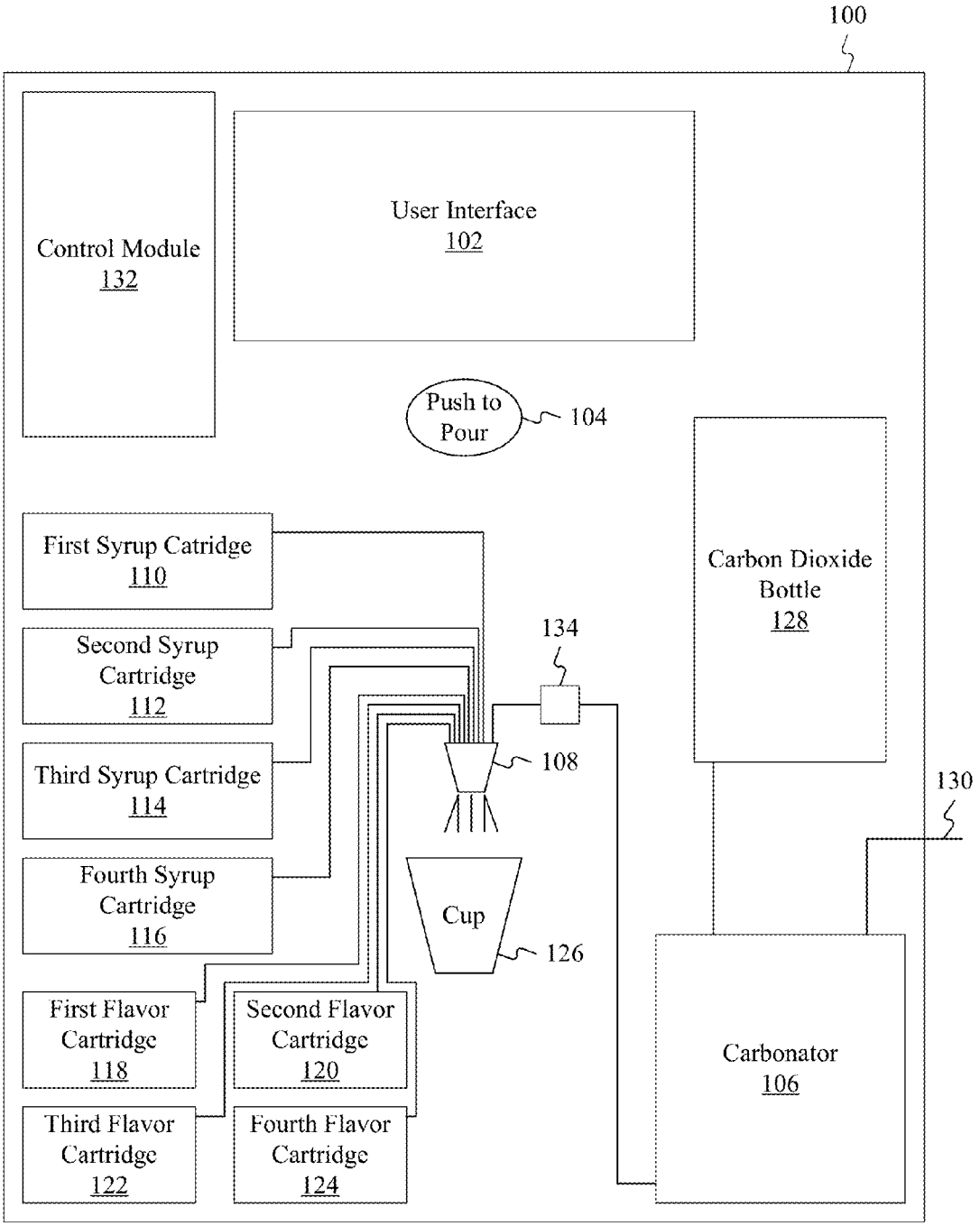
FIG. 1 shows a schematic of a beverage dispenser.

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

Embodiments may include an apparatus for controlling a fluid flow. The apparatus may include a flow channel, a housing, a flow restrictor, and a housing adjustment member. The flow channel defines a fluid pathway for the fluid flow. The fluid pathway includes an inlet and an exit. The housing surrounds the flow channel. The housing comprises an exterior surface defining a first threaded portion. The flow restrictor is located within the housing and proximate the exit. The housing adjustment member includes a second threaded portion in contact with the first threaded portion.

Embodiments may include a method for controlling a fluid flow. The method comprises: causing the fluid flow to pass through a flow channel having an inlet and an exit; restricting, via a flow restrictor, the fluid flow, the flow restrictor located proximate the exit; and adjusting a position of the flow restrictor to further restrict or unrestrict the fluid flow.

Now turning to the figures, FIG. 1 shows a schematic of a beverage dispenser 100. The beverage dispenser 100 includes a user interface 102, a push to pour button 104, a carbonator 106, and a nozzle 108. Syrups may be stored in a plurality of syrup cartridges (e.g., a first syrup cartridge 110, a second syrup cartridge 112, a third syrup cartridge 114, and a fourth syrup cartridge 116). Flavors may be stored in a plurality of flavor cartridges (e.g., a first flavor cartridge 118, a second flavor cartridge 120, a third flavor cartridge 122, and a fourth flavor cartridge 124). The plurality of syrup cartridges and the plurality of flavor cartridges are connected to the nozzle 108.

It should be understood that the plurality of syrup cartridges and plurality of flavor cartridges may include any number of ingredients including, but not limited to, sweetened beverage bases or beverage syrups, sweetened flavors or flavor syrups, unsweetened beverage bases, unsweetened beverage base components (such as the acid, acid-degradable, and non-acid portions of a beverage base), unsweetened flavors, natural and artificial flavors, flavor additives, natural and artificial colors, nutritive or non-nutritive natural or artificial sweeteners, additives for controlling tartness (e.g., citric acid, potassium citrate, etc.), functional additives such as vitamins, minerals, or herbal extracts, nutraceuticals, medicaments, or alternative diluents such as juice, milk, or yoghurt. The ingredients may be concentrated with traditional beverage ingredients having reconstitution ratios of about 3:1 to about 6:1 or higher. The beverage micro-ingredients may have reconstitution ratios from about 10:1, 20:1, 30:1, or higher with many having reconstitution ratios of about 50:1 to 300:1. The viscosities of the ingredients may range from about 1 to about 100 centipoise.

During operation, a user may select a beverage using the user interface 102. When the user presses the push to pour button 104, carbonated water flows from the carbonator 106 to the nozzle 108 and the appropriate syrups and flavors flow from the plurality of syrup cartridges and the plurality of flavor cartridges. In a post mix beverage dispenser, the syrups, flavors, and carbonated water mix after exiting the nozzle 108. For example, if a user selects a cherry flavored cola, carbonated water will flow from the carbonator 106 to the nozzle 108. The cola syrup and cherry flavoring will flow from the appropriate cartridges to the nozzle 108. The ingredients will then flow through the nozzle 108 and mix within the exiting fluid stream and a cup 126.

The carbonated water is formed within the carbonator 106. To form the carbonated water $CO_2$ flows from a carbon dioxide source (e.g., a carbon dioxide bottle 128) to the carbonator 106. Still water may flow into the carbonator 106 from an external source 130. In some embodiments, the still water source may be included within the beverage dispenser 100. The cooperation of the beverage dispenser 100 may be controlled by a control module 132. The control module 132 may also monitor a backpressure, via a pressure sensor 134, within the plumbing between the carbonator 106 and the nozzle 108.

Figure 2:
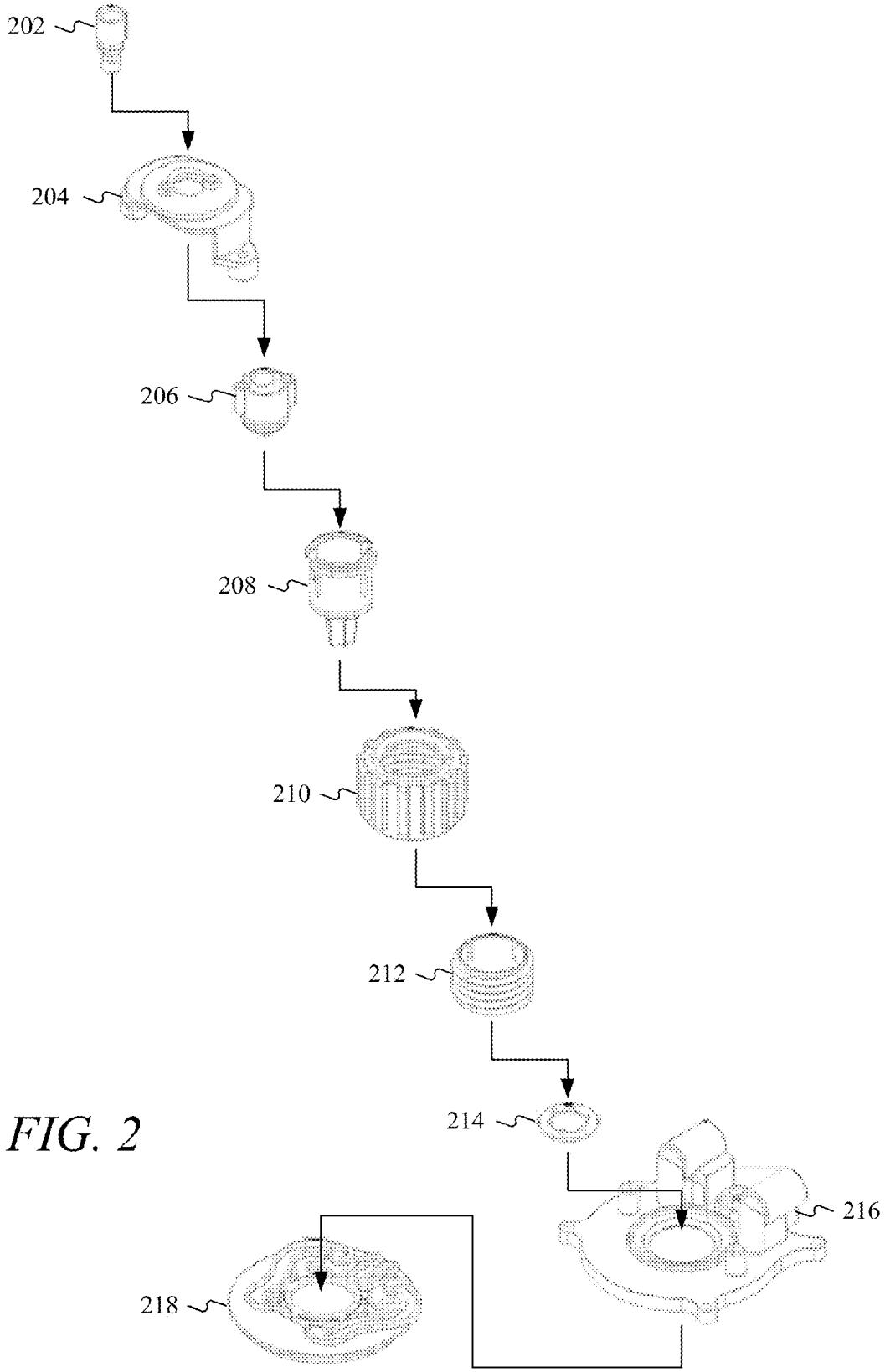
FIG. 2 shows an exploded assembly of a nozzle.

FIG. 2 shows an exploded assembly of the nozzle 108. The nozzle 108 may include a fill fitting 202, a clamp 204, a water channel 206 (described in greater detail with respect to FIG. 5), a flow change 208 (described in greater detail with respect to FIGS. 6A and 6B), a housing adjustment member 210 (described in greater detail with respect to FIG. 8), a housing 212 (described in greater detail with respect to FIG. 9), a flow restrictor 214 (described in greater detail with respect to FIG. 7), a distributor top 216 (described in greater detail with respect to FIG. 11), and a distributor 218 (described in greater detail with respect to FIGS. 10A and 10B).

The fill fitting 202 connects the nozzle 108 to the plumbing connecting the nozzle 108 to the carbonator 106. The fill fitting 202 passes through the clamp 204 and connects to the water channel 206. The water channel 206 connects the fill fitting 202 to the flow channel 208. The flow channel 208 passes though the housing adjustment member 210 and the housing 212. The flow restrictor 214 is located proximate an exit of the flow channel 208 and between the flow channel 208 and the housing 212. Clamp 204 is used to secure the various components of the nozzle 108 to the distributor top 216.

Figure 3:
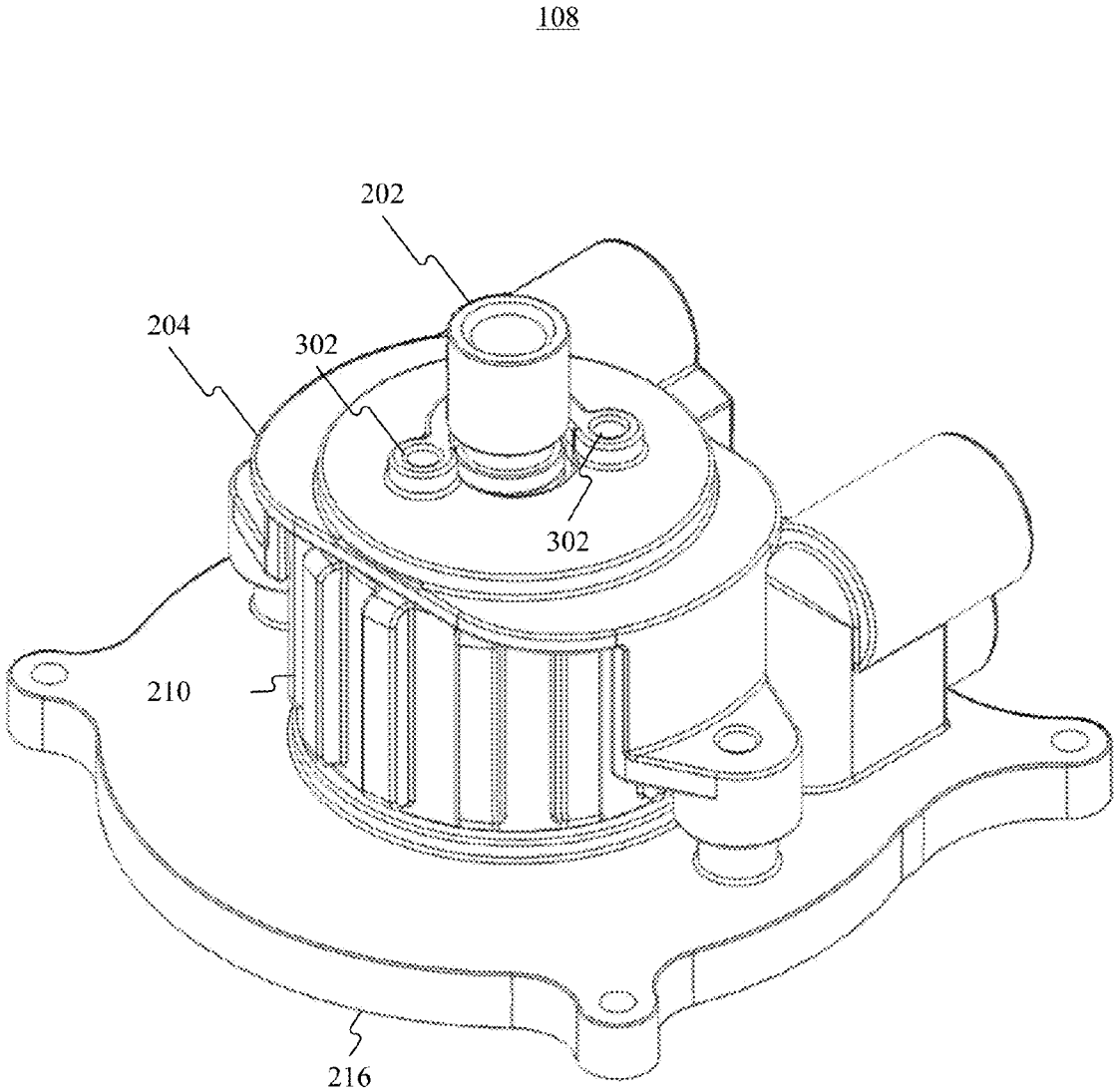
FIG. 3 shows the nozzle.
Figure 4:
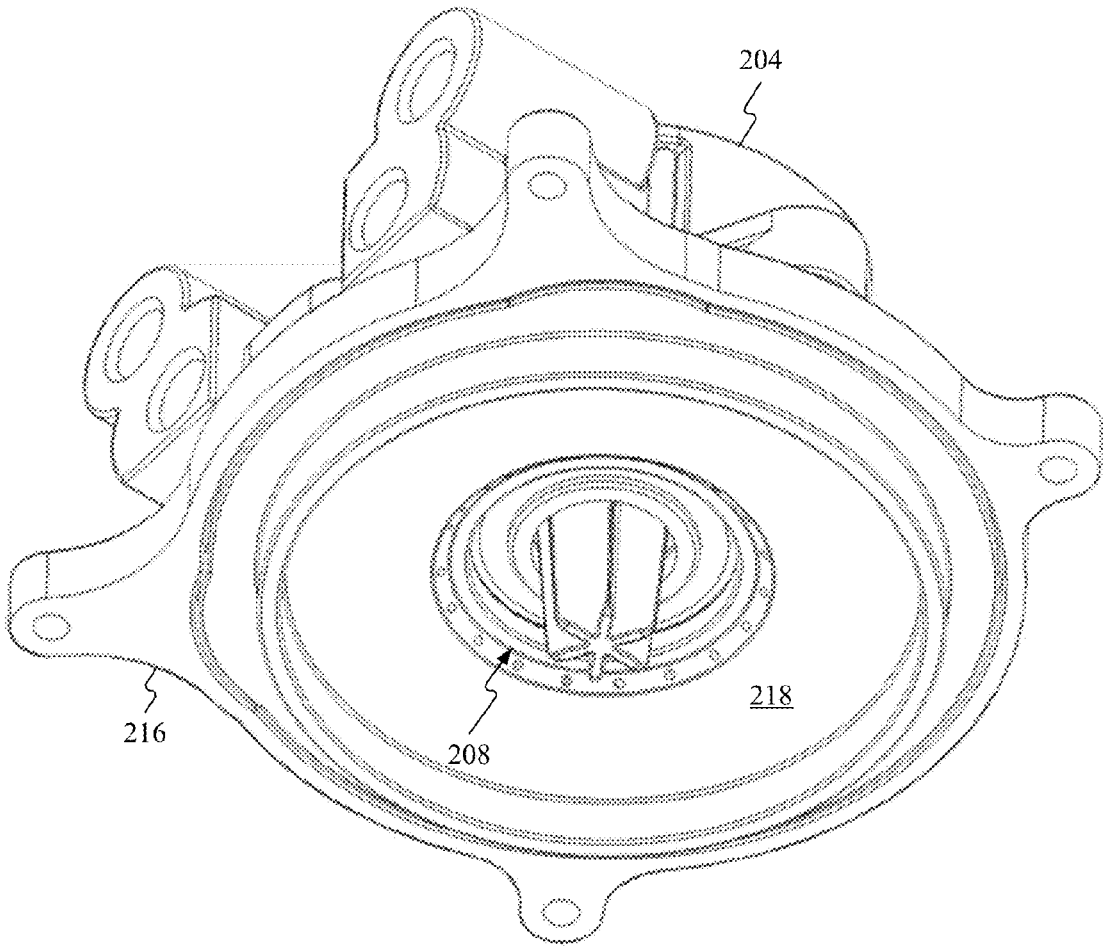
FIG. 4 shows the nozzle.
Figure 5:
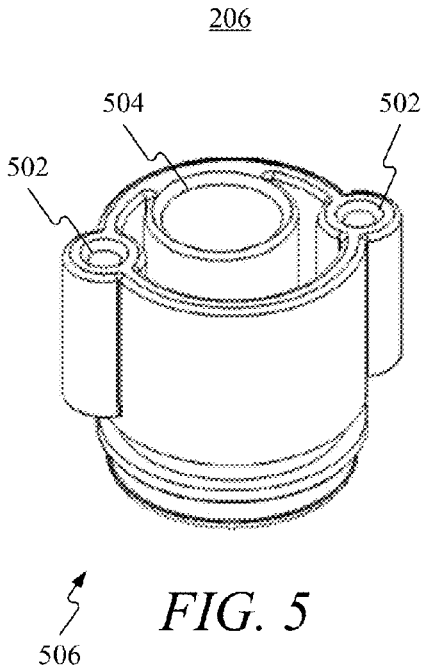
FIG. 5 shows a water channel.

FIG. 5 shows the water channel 206. The water channel 206 includes two mounting holes 502. During assemble two screws, or other fasteners, pass through two holes 302 in the clamp 204 (see FIG. 3) to secure the water channel 206 to the clamp 204. The fill fitting 202 connects to the water channel 206 by insertion into a mounting hole 504. The connection between the fill fitting 202 and the water channel 206 is sealed with an 0-ring (not shown). The water channel 206 connects to the flow channel 208 by inserting a male portion 506 into an inlet 602 (see FIG. 6B). The connection between the water channel 206 and the inlet 602 is sealed with an O-ring (not shown).

Figure 6A:
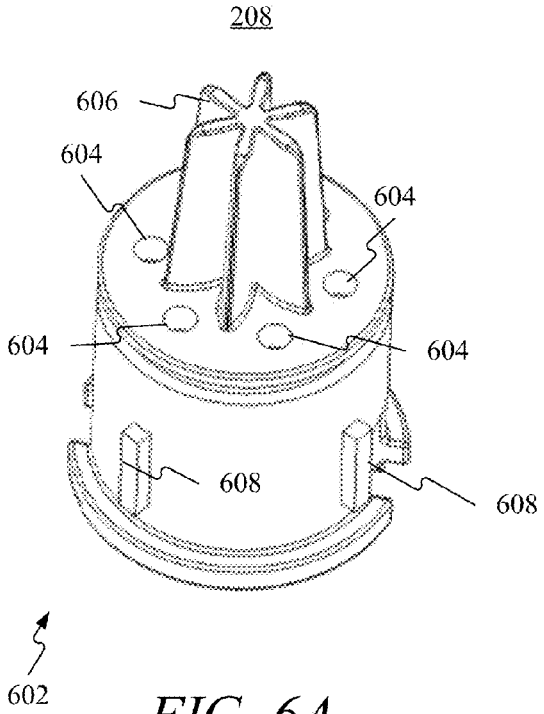
FIGS. 6A and 6B show a flow channel.
Figure 6B:
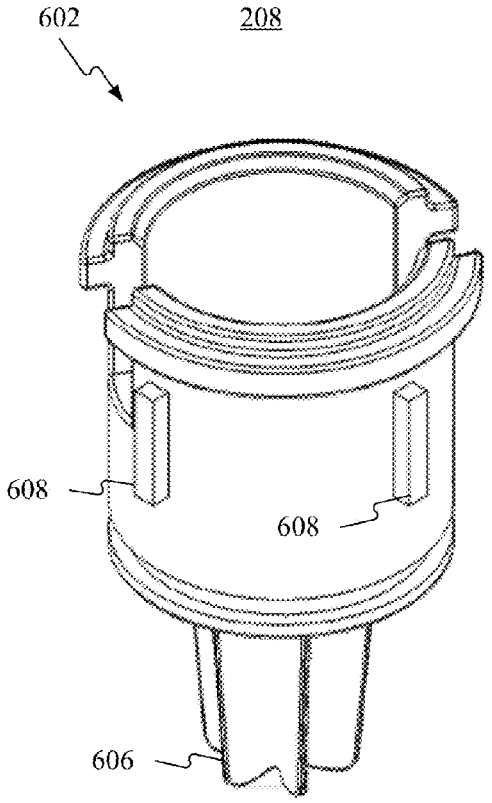

FIGS. 6A and 6B show the flow channel 208. The flow channel 208 defines the inlet 602. The inlet 602 connects a fluid pathway defined by the flow channel 208 to exits 604. Each of the exits 604 allow still or carbonated water to pass a flow straightener 606. The exits 604 may have a tapered profile. While FIG. 6A shows the exits 604 as a plurality of holes, the exit could be a single hole or any other shape. Furthermore, while the flow straightener's 606 shape, as shown in FIG. 6A directs the fluid flow along a straight path, the flow straightener 606 may have a helical profile or other profiles. For example, the flow straightener 606 may have a helical profile with perforations to facilitate mixing of the carbonated water with the syrups and flavors. The flow channel 208 may also include protrusions 608. The protrusions 608 may be used to align and/or secure the flow channel 208 within the housing 212.

Figure 7:
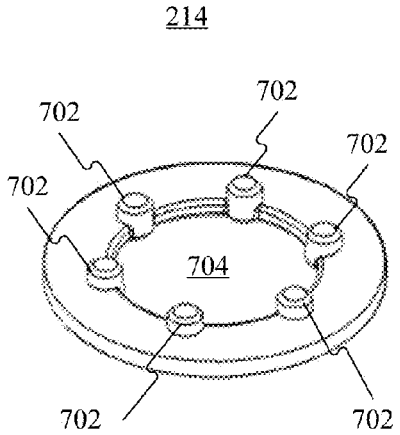
FIG. 7 shows a flow restrictor.

FIG. 7 shows the flow restrictor 214. The flow restrictor 214 includes protuberances 702. The protuberances 702 are sized to mate with exits 604. The flow restrictor 215 is manufactured from a resilient material. The protuberances 702 are tapered to compliment the tapered profile of the exits 604. During assembly the flow straightener 606 passes through an opening 704 defined by the flow restrictor 214.

Figure 8:
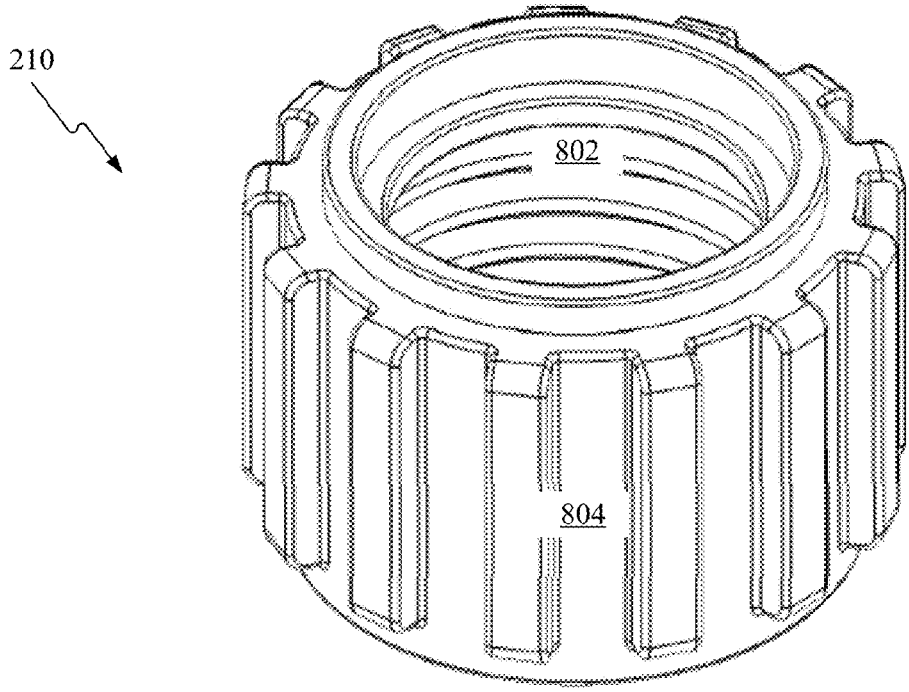
FIG. 8 shows a housing adjustment member.

FIG. 8 shows the housing adjustment member 210. The housing adjustment member 210 includes an interior surface defining a threaded portion 802. In addition, the housing adjustment member 210 includes an exterior surface defining a gear like profile 804. The gear like profile 804 may connect with a driving mechanism, such as a motor, a belt drive, or a sprocket system. The driving mechanism may allow the housing adjustment member 210 to be rotated to cause the housing 212 to traverse in an axial direction within the housing adjustment member 210.

Figure 9:
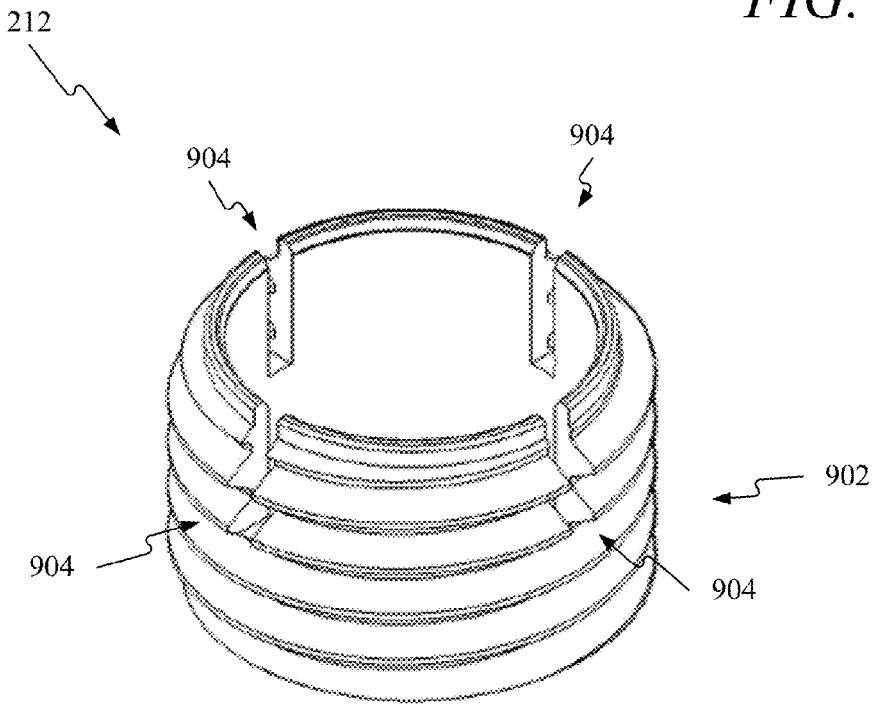
FIG. 9 shows a housing.

FIG. 9 shows the housing 212. The housing 212 includes an exterior surface defining a threaded portion 902. The threaded portion 902 may engage the threaded portion 802 defined by the housing adjustment member 210. The thread engagement allows the housing 212 to traverse in the axial direction when the housing adjustment member 210 is rotated. The housing also includes slots 904. The slots 904 receive the protrusions 608 located on the flow channel 208.

Figure 10A:
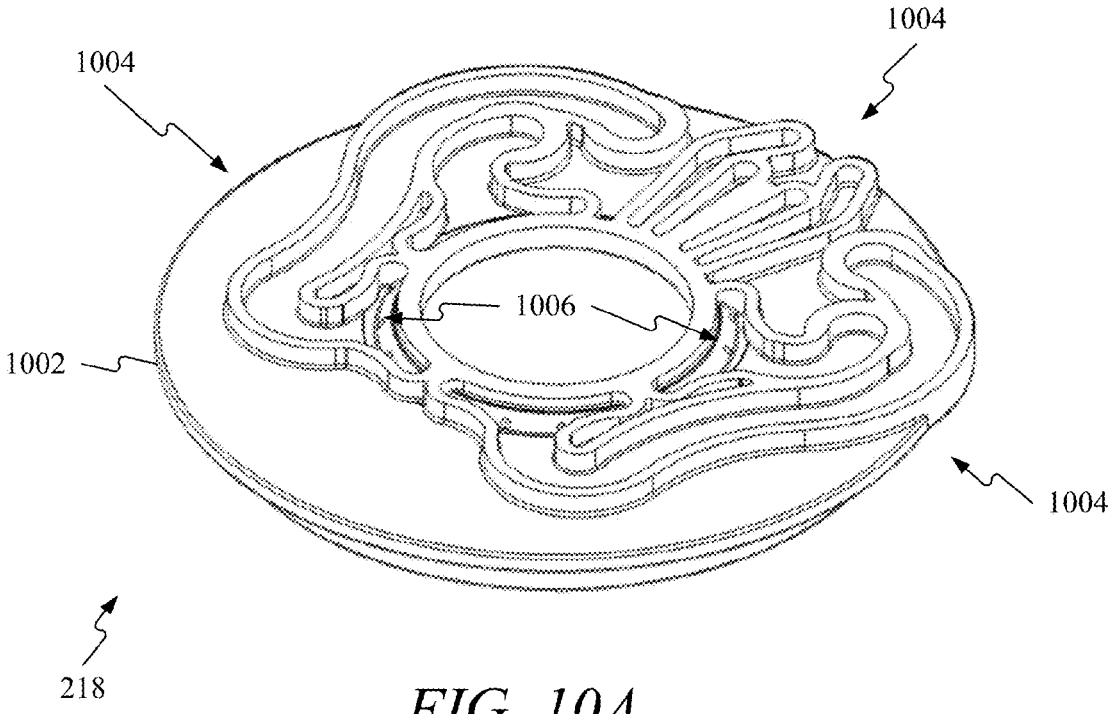
FIGS. 10A and 10B show a distributor.
Figure 10B:
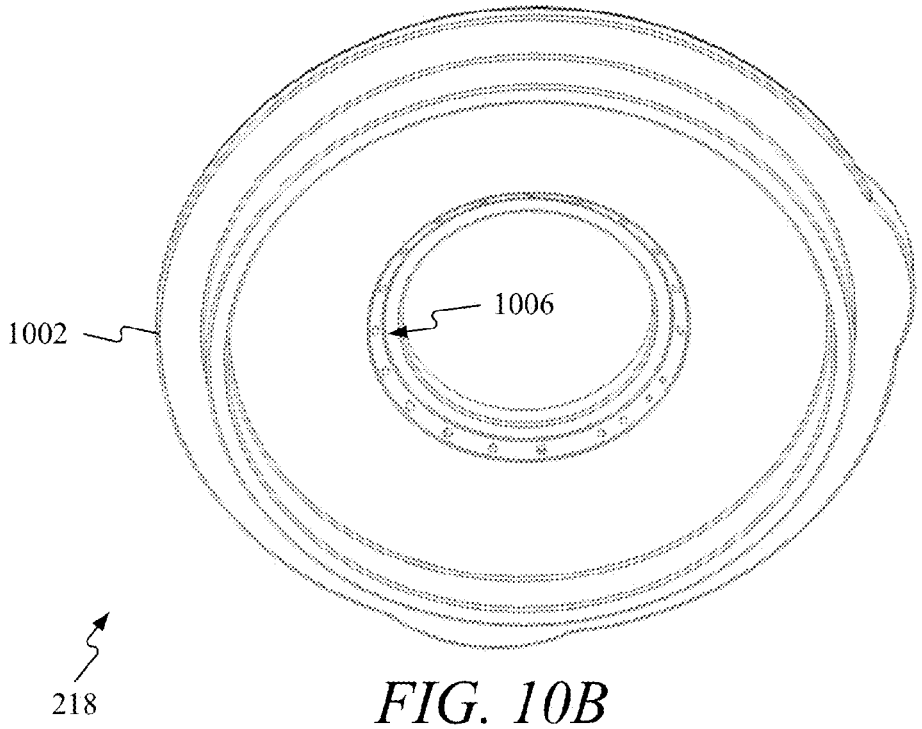

FIGS. 10A and 10B show the distributor 218. The distributor includes a base 1002. The base 1002 may define channels 1004. The channels 1004 deliver the ingredients (e.g., syrups and flavors) to delivery ports 1006. The size of each channel 1004 depends on the ingredients flowing through it. For example, channels 1004 that deliver macro-ingredients (e.g., syrups) may have a larger volume than channels 1004 that deliver micro-ingredients (e.g., flavors). Similarly, the number of delivery ports 1006 in each channel may depend on the ingredients flowing through it. For example, channels 1004 that deliver macro-ingredients may have more delivery ports 1006 (e.g., four delivery ports 1006) than channels 1004 that deliver micro-ingredients (e.g., one delivery port 1006). As will be discussed in greater detail below, the delivery ports 1006 are arranged to inject the ingredients into a flow of carbonated water passing through the flow channel 208. The flow straightener 606 passes through the opening located in the center of the distributor 218.

Figure 11A:
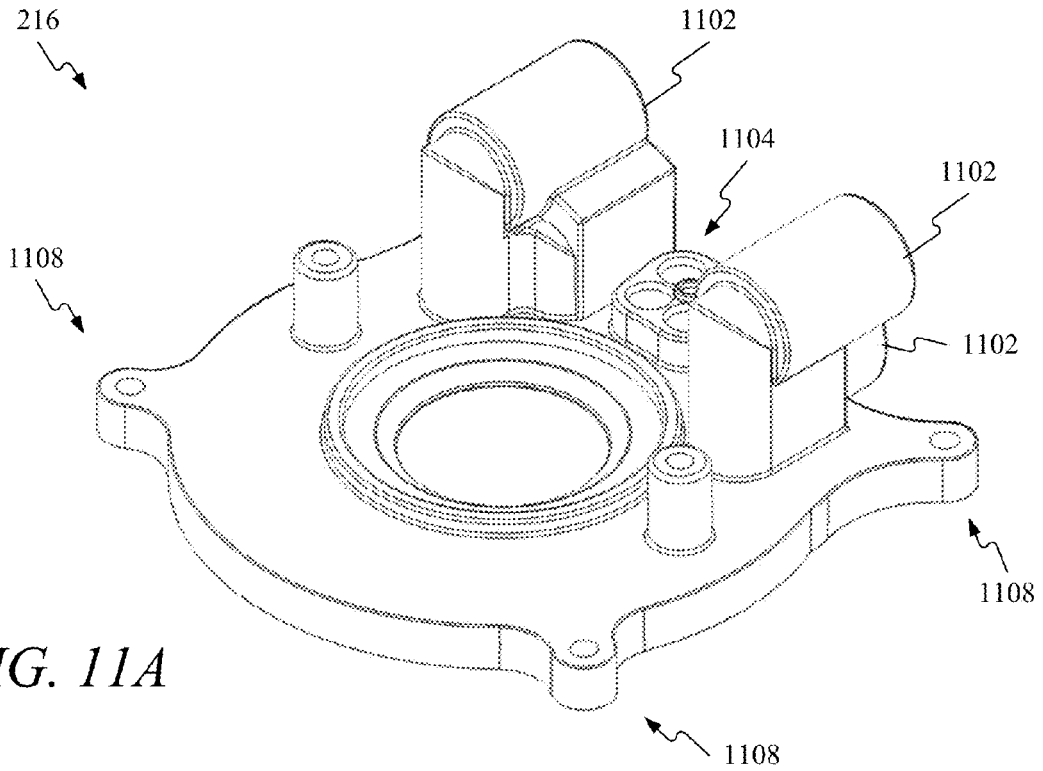
FIGS. 11A and 11B show a distributor top.
Figure 11B:
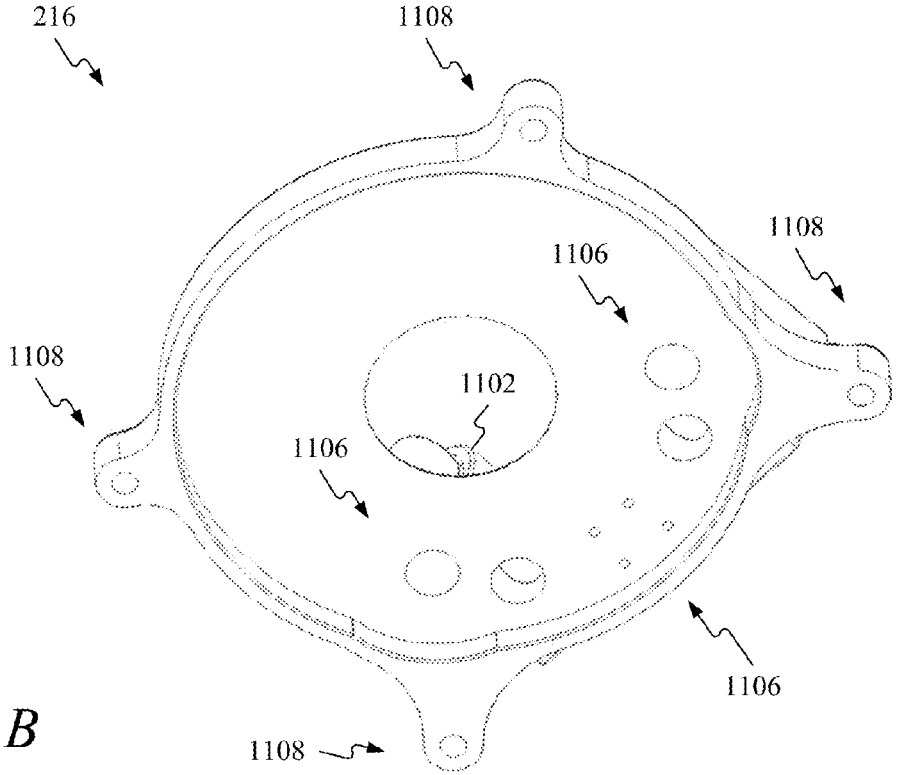

FIGS. 11A and 11B show the distributor top 216. The distributor top 216 includes syrup ports 1102 and flavor ports 1104. The flavor ports 1104 connect the distributor top 216 to the plurality of flavor cartridges. There is one flavor port 1004 for each flavor cartridge. In addition, the syrup ports 1102 connect the distributor top 216 to the plurality of flavor cartridges. There is one syrup port 1102 for each syrup cartridge.

Each of the flavor ports 1104 and the syrup ports 1102 connect to the channels 1004 located in the distributor 218. During operation, the flavors and syrups flow through their respective ports and into their respective channels 1004 via outlets 1106. When the distributor top 216 is connected to the distributor 218 the channels seal so that the various flavors and ingredients do not mix within the distributor 218 distributor top 216 assembly. The distributor top 216 is secured to the beverage dispenser 100 via screws passing through mounting holes 1108.

Figure 12:
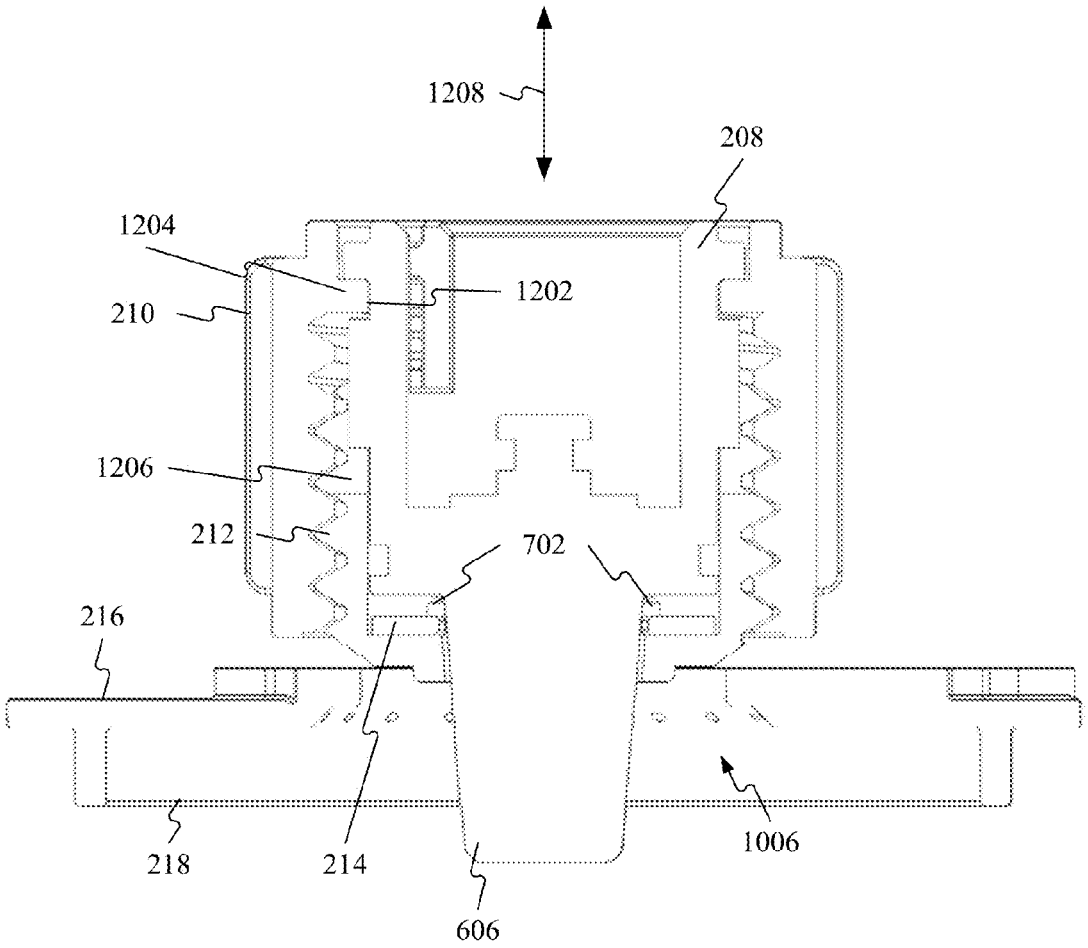
FIG. 12 shows a section of the distributor, distributor top, flow channel, housing, housing adjustment member, and flow restrictor.

FIG. 12 shows a section of the distributor 218, distributor top 216, flow channel 208, housing 212, housing adjustment member 210, and flow restrictor 214. As shown in FIG. 12, a groove 1202 located in the flow channel 208 receives a tenon 1204 located on the housing adjustment member 210. The mating of the groove 1202 and the tenon 1204 provides support for the flow channel 208. The flow channel 208 also includes a recess 1206. The recess 1206 allows the housing 212 to traverse in an axial direction as indicated by arrow 1208. The traversing motion is caused by rotation of the housing adjustment member 210. As the housing traverses, the flow restrictor 214 also traverses in the axial direction. When the flow restrictor 214 contacts the flow channel the protuberances 702 block the exits 604.

The position of the flow restrictor 214 allows for a backpressure between the nozzle 108 and the carbonator 106 to be maintained. As the flow restrictor 214 moves towards the downward position or away from the exits 604, the protuberances 702 block less and less of exits 604. This causes less restriction in the flow of still or carbonated water and therefore reduces the backpressure. Similarly, as the flow restrictor 214 moves towards the upward position or towards the exits 604, the protuberances 702 block more and more of the exits 604. This causes more restriction in the flow of still or carbonated water and therefore increases the backpressure.

As the carbonated water flows through the flow channel 208, it exits the nozzle 108 at flow straightener 606. After the carbonated water has exited the flow channel 208, the ingredients (e.g., syrups and flavors) exit the delivery ports 1006 to form a post-mix beverage. In other words, the ingredients mix with the carbonated water in an exit stream and in the cup 126.

Figure 13:
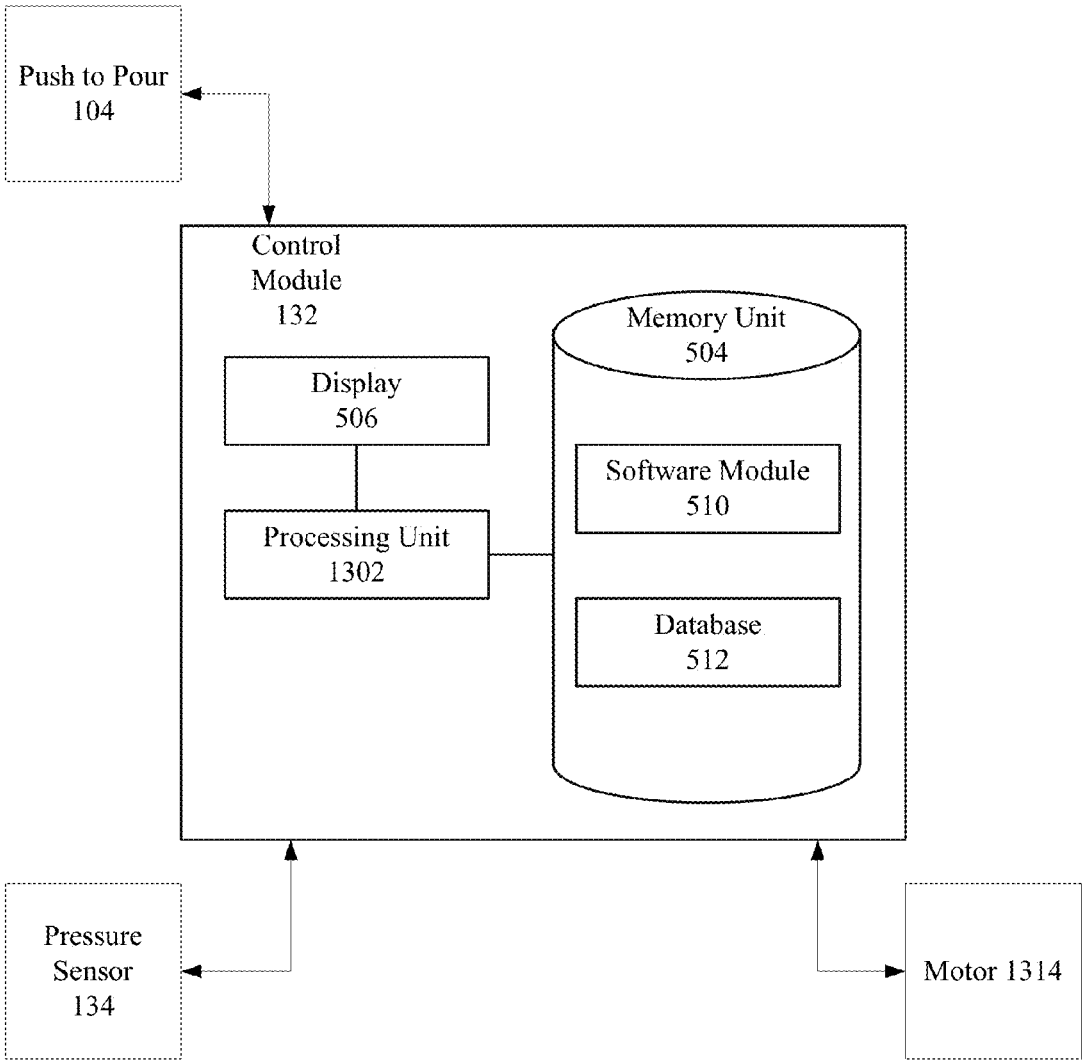
FIG. 13 shows a control module.

As shown in FIG. 13, control module 132 may include a processing unit 1302, a memory unit 1304, and a display 1306 (e.g., user interface 102). Memory unit 1304 may include a software module 1310 and a database 1312. The control module 132 may send and receive signals (e.g., inputs and outputs) from motor 1314, the pressure sensor 134, and the push to pour button 104. While executing on processing unit 1302, software module 1310 may perform processes for controlling a flow, including, for example, one or more stages included in method 1400 described below with respect to FIG. 14.

Control module 132 ("the processor") may be implemented using a personal computer, a network computer, a mainframe, a smartphone, or other similar computer-based system. The processor may comprise any computer operating environment, such as hand-held devices, multiprocessor systems, microprocessor-based or programmable sender electronic devices, minicomputers, mainframe computers, and the like. The processor may also be practiced in distributed computing environments where tasks are performed by remote processing devices. Furthermore, the processor may comprise a mobile terminal, such as a smart phone, a cellular telephone, a cellular telephone utilizing wireless application protocol (WAP), personal digital assistant (PDA), intelligent pager, portable computer, a hand held computer, or a wireless fidelity (Wi-Fi) access point. The aforementioned systems and devices are examples and the processor may comprise other systems or devices.

Embodiments, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present invention may be embodied in hardware and/or in software (including firmware, resident software, micro-code, etc.). In other words, embodiments of the present invention may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

While certain embodiments have been described, other embodiments may exist. Furthermore, although embodiments have been described as being associated with data stored in memory and other storage mediums, data can also be stored on or read from other types of computer-readable media, such as secondary storage devices, like hard disks, floppy disks, or a CD-ROM, a carrier wave from the Internet, or other forms of RAM or ROM. Further, the disclosed methods' stages may be modified in any manner, including by reordering stages and/or inserting or deleting stages, without departing from the invention.

Embodiments, for example, are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

Figure 14:
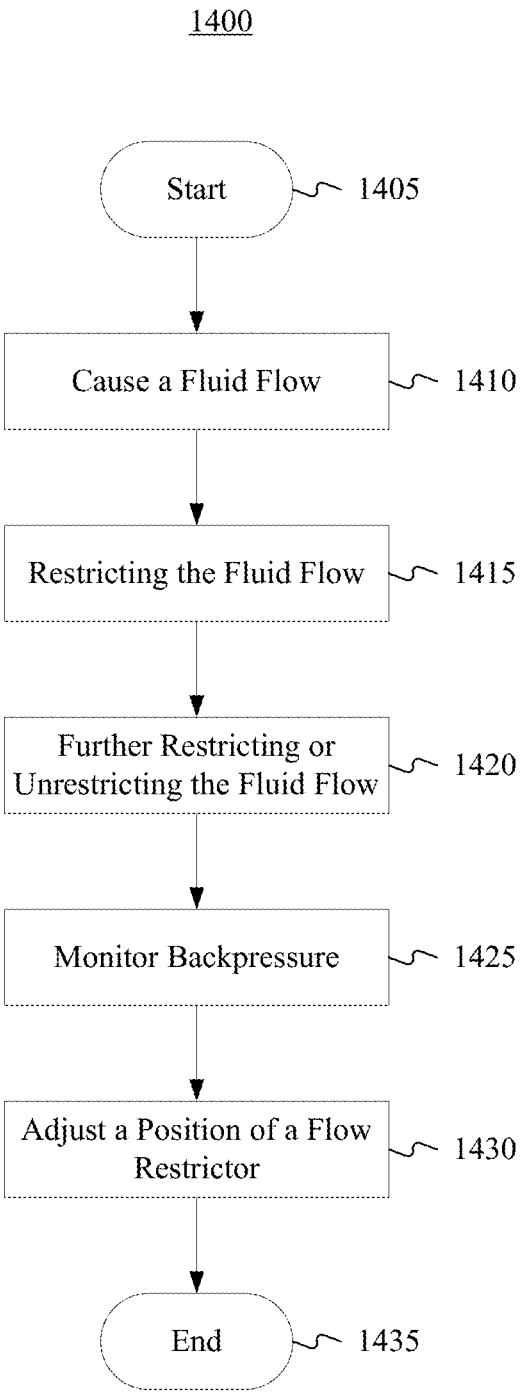
FIG. 14 shows a flow chart for controlling flow.

FIG. 14 shows a flow chart for a method 1400 for controlling a fluid flow. The method 1400 may begin at starting block 1405 and proceed to stage 1410 where a fluid flow is caused to flow through the flow channel 208. For example, a user may press the push to pour button 104 and carbonated water may flow from the carbonator 106 through the flow channel 208.

From stage 1410 where the fluid flow is cause, the method 1400 may proceed to stage 1415 where the fluid flow may be restricted. For example, as the flow of carbonated water exits the exits 604 the flow may be restricted by protuberances 702. From stage 1415 where the flow is restricted, the method 1400 may proceed to stage 1420 where the flow may be further restricted or unrestricted. For example, the position of the flow restrictor 214 may be changed as described above to further restrict or unrestrict the fluid flow. In other words, a portion of the protuberances 702 may be caused to penetrate the exits 604.

From stage 1420 where the fluid flow is further restricted or unrestricted, the method 1400 may proceed to stage 1425 where the back pressure upstream of the flow channel 208 is monitored. For instance, pressure sensor 134 may monitor the backpressure and send a signal to control module 132 indicating the backpressure.

From stage 1425 the method 1400 may proceed to stage 1430 where the position of the flow restrictor 214 may be adjusted. For example, the control module 132 may interpret the signal from the pressure sensor 134 as indicating the backpressure is too high. As a result, the control module 132 may actuate the motor 1314. The motor 1314 may then cause the housing adjustment member 210 to rotate thereby repositioning the flow restrictor 214 to lower the backpressure. Depending on the speed of the motor 1314 and the response time of the pressure sensor 134, the adjustment of the flow restrictor 214 may occur in near real time. In other words, based on input from the pressure sensor 134, the control module 132 may actuate the motor 1314 to continuously reposition the flow restrictor 214 to maintain a near constant backpressure. From stage 1430, the method 1400 may terminate at termination block 1435.

The various embodiments described above are provided by way of illustration only and should not be construed to limit the claims attached hereto. Various modifications and changes may be made without following the example embodiments and applications illustrated and described herein, and without departing from the scope of the invention defined by the following claims.

What is claimed is:

1. An apparatus for controlling a fluid flow, the apparatus comprising:

a flow channel defining a fluid pathway for the fluid flow, the fluid pathway including an inlet and an exit;

a housing surrounding the flow channel, the housing comprising an exterior surface defining a first threaded portion;

a flow restrictor located within the housing and proximate the exit;

a housing adjustment member comprising a second threaded portion in contact with the first threaded portion;

a distributor defining a first flow channel in fluid communication with a first plurality of delivery ports located proximate the exit and a second flow channel in fluid communication with a second plurality of delivery ports located proximate the exit; and a distributor top bounding at least a portion of the first flow channel and the second flow channel, the distributor top defining a first input port in fluid communication with the first flow channel and a second input port in fluid communication with the second flow channel.

2. The apparatus of claim 1, wherein the flow restrictor comprises a protuberance sized to at least partially block the exit.

3. The apparatus of claim 1, wherein the flow channel passes through the distributor and the distributor top, the first plurality of delivery ports arranged to inject a second flow into the fluid flow, the second plurality of delivery ports arranged to inject a third flow into the fluid flow.

4. The apparatus of claim 1, wherein the first plurality of delivery ports and the second plurality of delivery ports are arranged to cause post-mixing.

5. The apparatus of claim 1, wherein the housing and flow restrictor are arranged to maintain a consistent backpressure within the fluid flow.

6. The apparatus of claim 1, wherein the flow channel defining the fluid pathway comprises the flow channel defining an annulus, and wherein the flow restrictor comprises at least one protuberance having a protuberance complimentary to the annulus.

7. A beverage dispenser comprising:

a carbonator; and a nozzle in fluid communication with the carbonator, nozzle comprising:

a flow channel defining a fluid pathway for the fluid flow, the fluid pathway including an inlet and an exit, the inlet in fluid communication with the carbonator;

a housing surrounding the flow channel, the housing comprising an exterior surface defining a first threaded portion;

a flow restrictor located within the housing and proximate the exit; and a housing adjustment member comprising a second threaded portion in contact with the first threaded portion;

a distributor defining a first flow channel in fluid communication with a first plurality of delivery ports located proximate the exit and outside the flow channel and a second flow channel in fluid communication with a second plurality of delivery ports located proximate the exit and outside the flow channel; and a distributor top bounding at least a portion of the first flow channel and the second flow channel, the distributor top defining a first input port in fluid communication with the first flow channel and a second input port in fluid communication with the second flow channel.

8. The beverage dispenser of claim 7, wherein the flow restrictor comprises a protuberance sized to at least partially block the exit.

9. The beverage dispenser of claim 7, wherein the housing and flow restrictor are arranged to maintain a consistent backpressure within the fluid flow.

10. The beverage dispenser of claim 7, wherein the flow channel defining the fluid pathway comprises the flow channel defining an annulus, and wherein the flow restrictor comprises at least one protuberance having a protuberance complimentary to the annulus.

11. The beverage dispenser of claim 7, wherein the flow channel passes through the distributor and the distributor top, the first plurality of delivery ports arranged to inject a second flow into the fluid flow, the second plurality of delivery ports arranged to inject a third flow into the fluid flow.

12. The beverage dispenser of claim 11, wherein the first plurality of delivery ports and the second plurality of delivery ports are arranged to cause post-mixing.

13. The beverage dispenser of claim 7, further comprising:

a pressure sensor located between the carbonator and the inlet;

a step motor mechanically coupled to the housing adjustment member; and a control module in electrical communication with the pressure sensor and the step motor.

14. The beverage dispenser of claim 13, wherein the pressure sensor is operative to output a signal to the control module, the signal indicating the backpressure, and wherein the control module is operative to actuate the step motor in response to receiving the signal, to maintain a constant backpressure within the flow channel.

* * * * *